US007416086B2

(12) United States Patent
Lanni

(10) Patent No.: US 7,416,086 B2
(45) Date of Patent: Aug. 26, 2008

(54) IN-LINE SORTER FOR FASTENERS

(75) Inventor: Victor A. Lanni, Ray Township, MI (US)

(73) Assignee: Acument Intellectual Properties LLC, Troy, MI (US)

( * ) Notice: Subject to any disclaimer, the term of this patent is extended or adjusted under 35 U.S.C. 154(b) by 283 days.

(21) Appl. No.: 11/054,284

(22) Filed: Feb. 9, 2005

(65) Prior Publication Data

US 2005/0242004 A1 Nov. 3, 2005

Related U.S. Application Data

(60) Provisional application No. 60/567,945, filed on May 3, 2004.

(51) Int. Cl.
*B07C 5/12* (2006.01)
*B07C 9/00* (2006.01)

(52) U.S. Cl. ..... 209/682; 209/659; 209/660; 209/684; 209/929

(58) Field of Classification Search ..... 209/682, 209/684, 659, 660; 221/156, 158
See application file for complete search history.

(56) References Cited

U.S. PATENT DOCUMENTS 3,739,908 A * 6/1973 Gunther ..... 209/558
4,181,603 A * 1/1980 Fox ..... 209/682
4,254,878 A * 3/1981 Marsh ..... 209/682
4,391,374 A * 7/1983 Krynock ..... 209/540
4,457,622 A * 7/1984 Kato et al. ..... 209/586
4,905,842 A * 3/1990 Habele et al. ..... 209/557
5,777,246 A * 7/1998 Woods et al. ..... 73/865.8
5,860,855 A * 1/1999 Alberti ..... 453/5
6,693,274 B2 * 2/2004 Baird et al. ..... 250/221
6,787,724 B2 * 9/2004 Bennett et al. ..... 209/586
6,805,245 B2 * 10/2004 Kenneway ..... 209/538
2003/0127372 A1 * 7/2003 Kenneway ..... 209/538
2003/0201211 A1 * 10/2003 Bennett et al. ..... 209/586

* cited by examiner

*Primary Examiner*—Patrick H. Mackey
*Assistant Examiner*—Terrell H Matthews
(74) *Attorney, Agent, or Firm*—Trexler, Bushnell, Giangiorgi, Blackstone & Marr, Ltd.

(57) ABSTRACT

An in-line sorter for fasteners which includes a track for receiving the head of a fastener. Fasteners move along the track, past one or more stations which reject those fasteners which do not meet certain specifications. Specifically, four stations may be provided—a first station for rejecting fasteners which have bolt portions which are too short; a second station for rejecting fasteners which have too long a head or too long a shaft portion extending above the head; a third station for rejecting fasteners which have bolt portions which are too long; and a fourth station for rejecting fasteners which have too large a head or washer portions which are either too small or too large. More or less than four stations may be provided. Also, the stations may be provided in a different sequence. Still further, in some cases, stations may be combined.

18 Claims, 12 Drawing Sheets

IN-LINE SORTER FOR FASTENERS

RELATED APPLICATION (PRIORITY CLAIM)

This application claims the benefit of U.S. Provisional Application Ser. No. 60/567,945, filed May 3, 2004.

BACKGROUND

This invention generally relates to devices and methods for sorting fasteners, and more specifically relates to an in-line sorter which can be implemented in a fastener feed system.

Fastener feed systems presently exist in the industry. Oftentimes, a batch of fasteners includes some fasteners which are not of the type or size of the rest of the batch. In other words, most fastener batches are not 100% uniform, and contain some anomalies (these anomalies may be referred to as "foreign fasteners"). Sometimes, foreign fasteners cause a feed system to jam, thereby causing the assembly line to shut down, and down time charges to be incurred. In fact, the fact that batches of fasteners are not 100% percent uniform is the number one cause of downtime in some engine and transmission assembly plants.

Automatically feeding fasteners in high volume production environments is relatively new in the industry (at least on an industry wide basis). Sometimes, no steps are taken to reduce the likelihood of system jamming due to foreign fasteners. Simply, when a jam occurs, a maintenance person is called upon to clear the jam. To decrease the likelihood of jams, the industry has generally switched from bowl feeder systems (which are more likely to jam) to step feeder systems (which are less likely to jam). Some fastener feed systems are intentionally designed to make it easier to clear a jam. To further decrease the likelihood of jams, often an OEM that is running an assembly line will demand that a fastener manufacturer deliver a batch of fasteners having zero defects (i.e., no foreign fasteners). Obviously, to deliver batches with no foreign fasteners requires increased cost and/or production steps.

OBJECT AND SUMMARY

An object of an embodiment of the present invention is provide an in-line sorter for fasteners, where the sorter is effective at preventing foreign fasteners from continuing to be fed through a feed system, thereby preventing jamming of the system, and eliminating down time.

Briefly, and in accordance with at least one of the foregoing objects, an embodiment of the present invention provides an in-line sorter for fasteners. The in-line sorter includes a track for receiving the head of a fastener or a flange on said fastener head, and is configured such that the fastener moves along the track, past one or more stations which are configured to reject fasteners which do not meet certain specifications.

In a specific, preferred embodiment, four stations are provided—a first station configured to reject a fastener, if a shaft portion is of improper length and does not extend far enough below the head (i.e., the bolt is too short); a second station configured to reject the fastener if the fastener head is not the proper configuration (i.e., is too high or too long, or a shaft portion extends too far above the head); a third station configured to reject the fastener, if the shaft portion extends too far below the head (i.e., the bolt is too long); and a fourth station configured to reject the fastener if the fastener head is not the desired configuration, as for example, too large, or a washer portion is either too small or too large.

While four stations may be provided, alternatively more or less than four stations may be provided. Also, the stations may be provided in a sequence which differs from that which has been described hereinabove. Still further, in some cases, stations may be combined.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
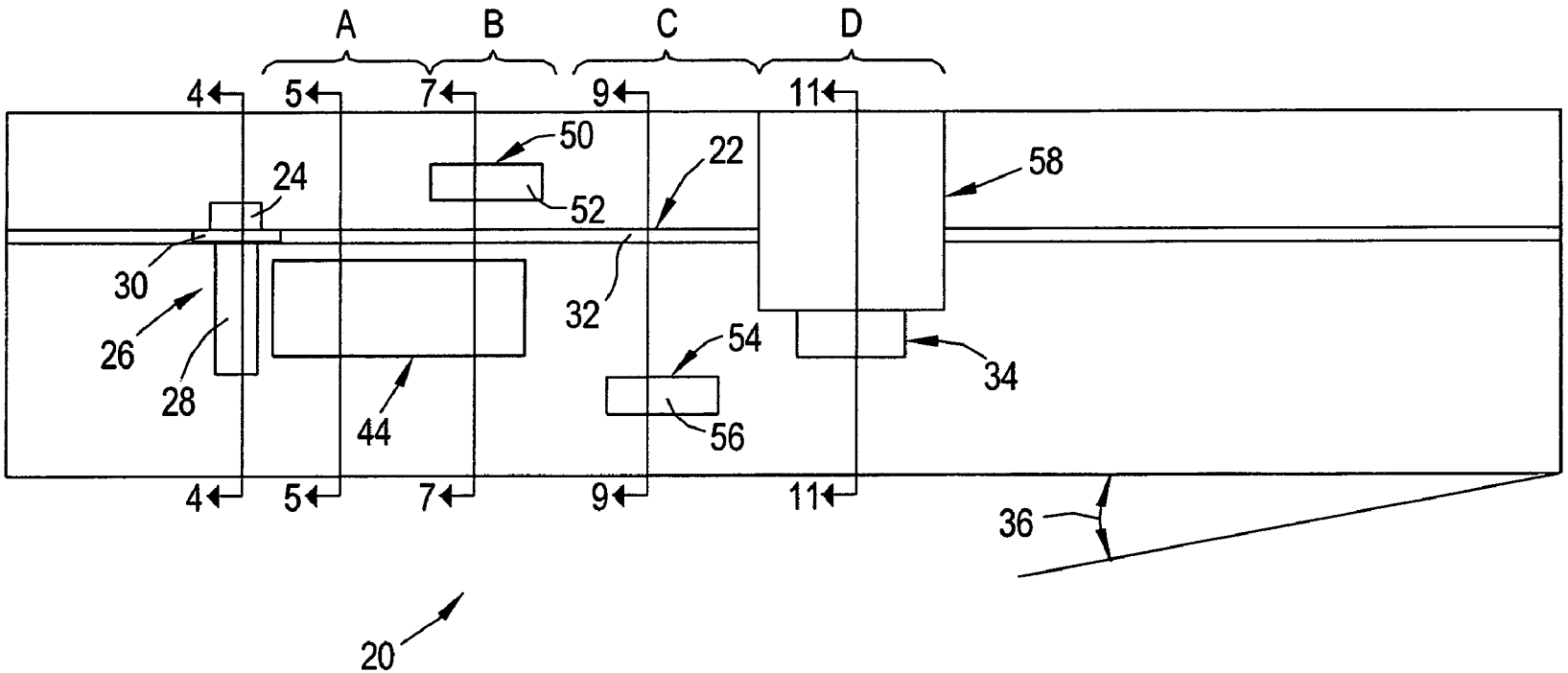
FIG. 1 is a front view of an in-line sorter which is in accordance with an embodiment of the present invention.

While the present invention may be susceptible to embodiment in different forms, there is shown in the drawings, and herein will be described in detail, an embodiment thereof with the understanding that the present description is to be considered an exemplification of the principles of the invention and is not intended to limit the invention to that as illustrated and described herein.

Figure 2:
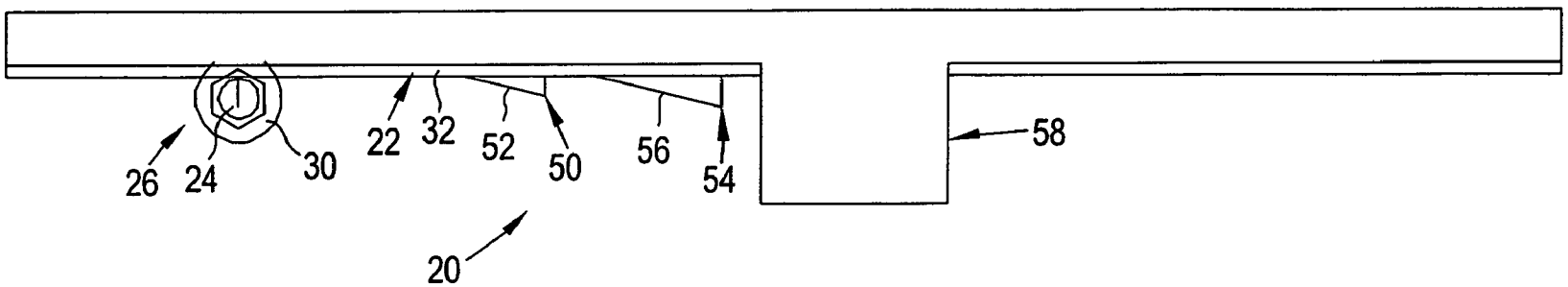
FIG. 2 is a top view of the in-line sorter.
Figure 3:
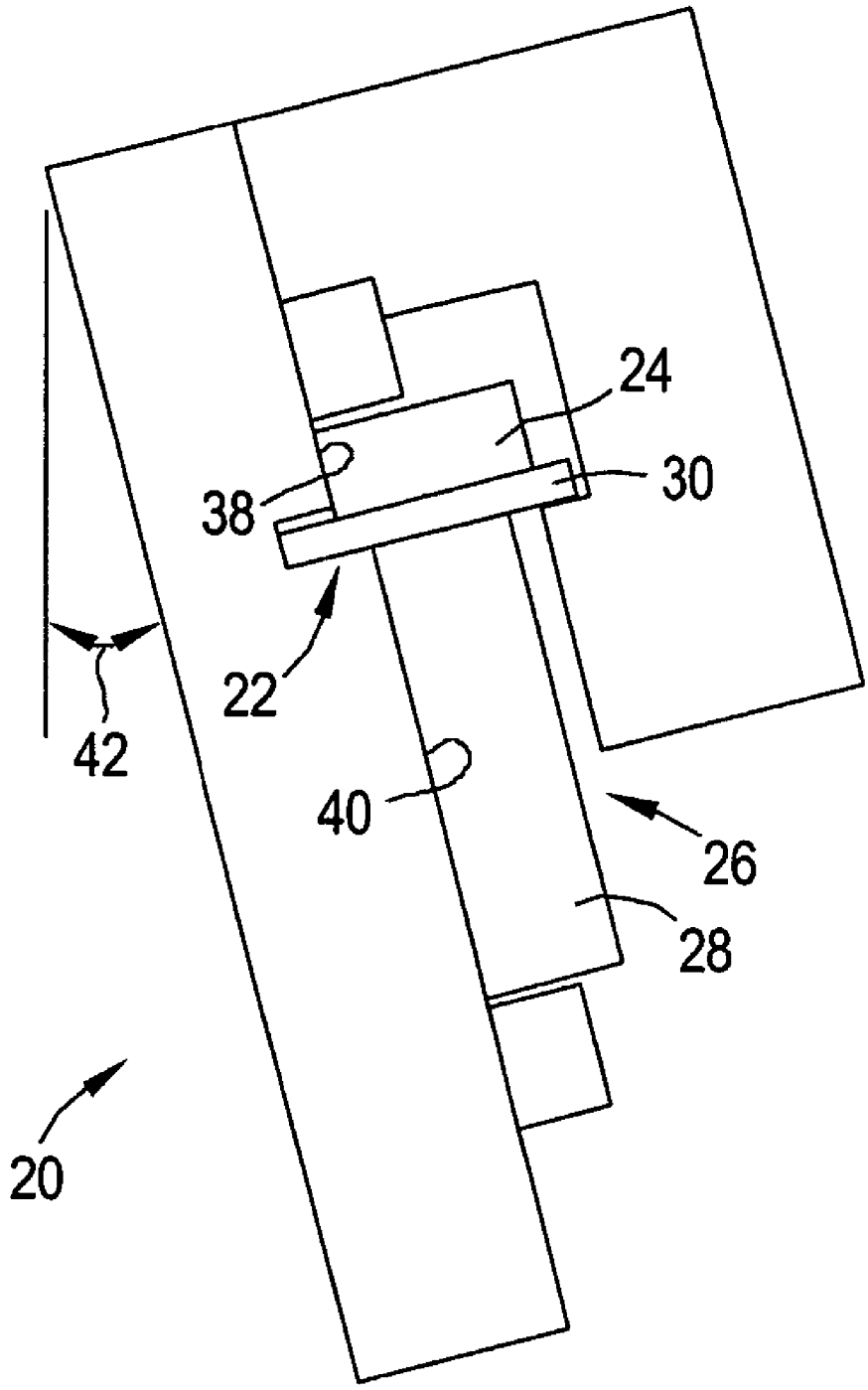
FIG. 3 is a side view of the in-line sorter.

FIGS. 1, 2 and 3 illustrate an in-line sorter 20 which is in accordance with an embodiment of the present invention. Specifically, FIG. 1 is a front view, FIG. 2 is a top view, and FIG. 3 is a side view of the in-line sorter 20. Preferably, the in-line sorter 20 is configured such that it can be positioned, such as bolted, inline with practically any type of fastener feed system, such as a step feed system or a bowl system, for example. The sorter 20 is configured such that fasteners move along the sorter 20, and the sorter 20 is effective at allowing only those fasteners which meet certain, pre-determined specifications to pass all the way through the sorter 20. Hence, the sorter 20 is effective at preventing foreign fasteners from continuing to be fed through a feed system, thereby preventing jamming and eliminating down time.

The sorter 20 includes a track 22 for receiving the head 24 of a fastener 26. Fasteners move along the track 22, past a plurality of stations, each of which is configured to reject fasteners which do not meet certain, pre-determined specifications. Specifically, the sorter 20 may include four stations, identified in FIG. 1 as "A", "B", "C" and "D", respectively. Station "A" rejects fasteners which have bolt portions (i.e., 28 in FIG. 1) which are too short; station "B" rejects fasteners which have too long a head (i.e., 24 in FIG. 1) or too long a shaft portion extending above the head 24; station "C" rejects fasteners which have bolt portions (i.e., 28 in FIG. 1) which are too long; and station "D" rejects fasteners which have too large or too short a head (i.e., 24 in FIG. 1), as well as those fasteners which have either too large or too small a washer portion (i.e., 30 in FIG. 1). Preferably, the four stations are designed such that if a fastener makes it past all four stations (i.e., none of the four stations reject the fastener), then the fastener is acceptable for continuing to be fed along the feed system (i.e., the fastener is not a foreign fastener and is compatible with the system).

As discussed above, the sorter 20 includes a track 22 for receiving the head 24 of a fastener 26. Specifically, the track 22 may be provided in the form of an extended recess or slot 32 which is configured to receive therein the washer portion 30 of a fastener 26. Other configurations for contact and movement of the fastener 26 along a sorter path may be employed, the illustrated recess or slot 32 being but one example. Preferably, the track 22 extends the entire length of the sorter 20 (except for where there is an opening 34 provided in station "D", as will be described later herein). As shown in FIG. 1, preferably the sorter 20 is angled relative to the horizontal. Specifically, preferably angle 36 is 15 degrees or more. The fact that the sorter 20 is angled relative to the horizontal provides that gravity will assist in the movement of the fasteners 26 through all four of the stations. In addition, the sorter 20 can be vibrated to facilitate movement of fasteners along the sorter 20, past each of the stations.

FIG. 3 is a side view of the in-line sorter 20. As shown in FIG. 3, the sorter 20 not only includes track 22, but also includes walls 38, 40 which tend to keep fasteners in the track 22. Preferably, the sorter 20 is also angled relative to the vertical. Specifically, preferably angle 42 is 20 degrees or more. The fact that the sorter 20 is angled relative to the vertical provides that fasteners tend to remain in the track 22 (i.e., due to gravity) unless one of the four succeeding stations causes the fastener to fall out or be pushed out of the track 22, away from the sorter 20.

Figure 4:
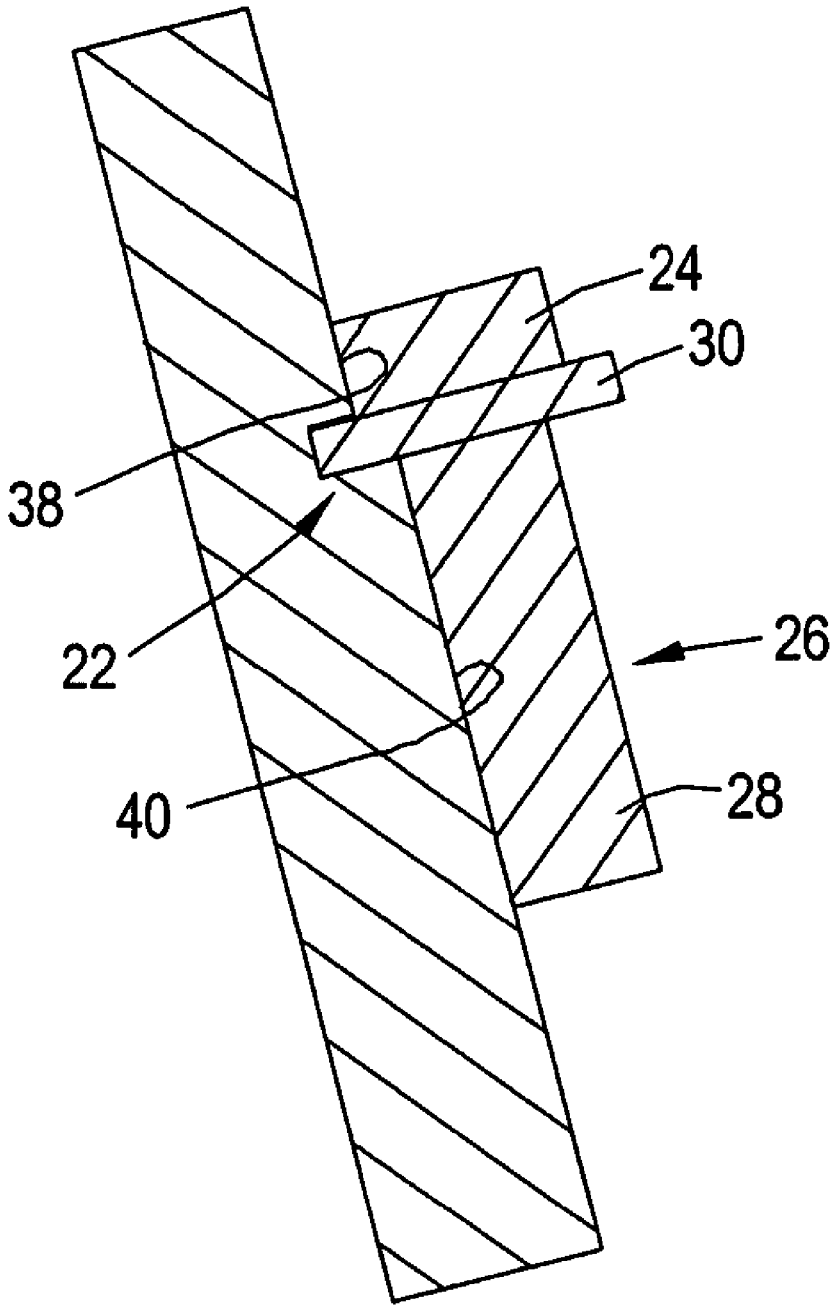
FIG. 4 is a cross-sectional view taken along line 4-4 of FIG. 1, showing a fastener in the starting position.

FIG. 4 is a cross-sectional view taken along line 4-4 of FIG. 1, showing fastener 26 in a position preceding the four stations. Each of the four stations (i.e., stations "A", "B", "C" and "D" as shown in FIG. 1) will now be discussed in detail with reference to FIGS. 5-12.

Figure 5:
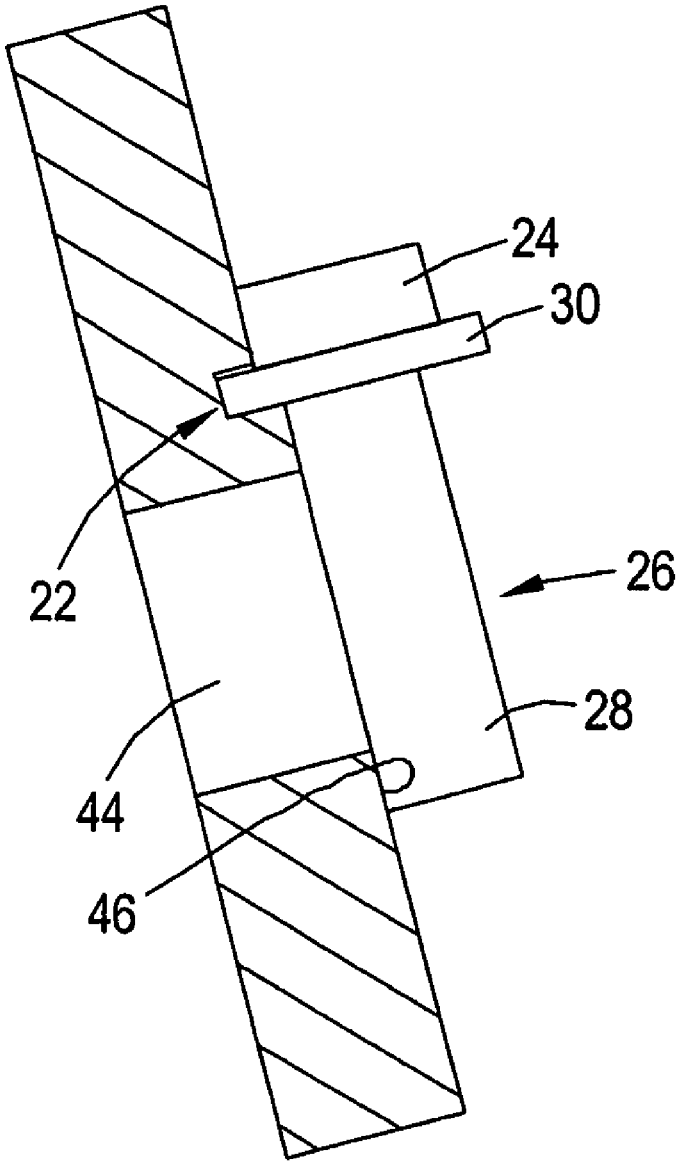
FIG. 5 is a cross-sectional view taken along line 5-5 of FIG. 1, showing a fastener at a first station, wherein a shaft portion of the fastener extends far enough below the head (i.e., the bolt is long enough) to pass the station.

FIG. 5 is a cross-sectional view taken along line 5-5 of FIG. 1, showing fastener 26 at the first station (i.e., station "A" in FIG. 1). The station includes an opening 44 which is shaped to provide that only fasteners of a sufficient length are able to pass thereby without the opening 44 causing the fastener to fall out of the track 22. FIG. 5 shows the situation wherein a shaft or bolt portion 28 of the fastener 26 extends far enough below the head 24 (i.e., the bolt 28 is long enough) to contact wall 46, thereby not tipping into the opening 44, therefore staying in the track 22, and being able to pass the station. If the fastener makes it past this station, the fastener proceeds to the next station (see FIG. 7).

Figure 6:
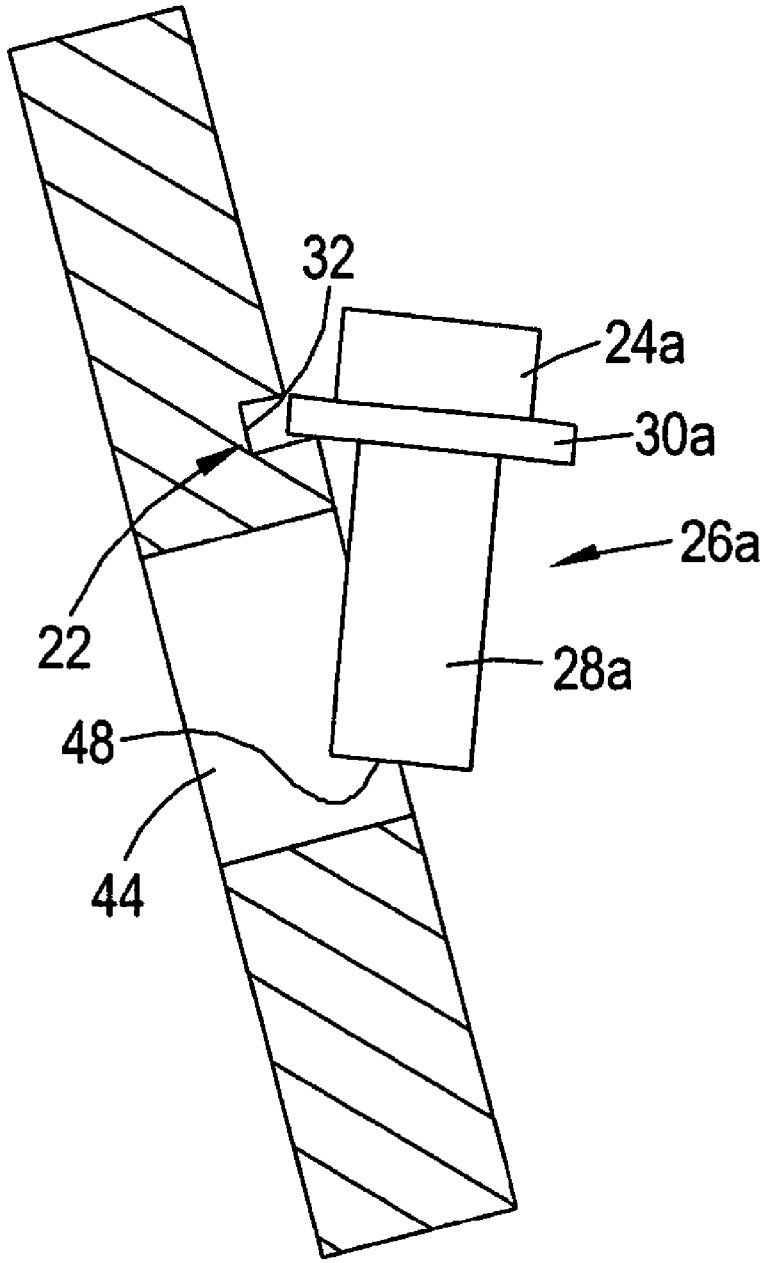
FIG. 6 is similar to FIG. 5, but shows the situation where the shaft portion of the fastener does not extend far enough below the head (i.e., the bolt is not long enough) to pass the station.

FIG. 6 is similar to FIG. 5, but shows the situation where the shaft or bolt portion 28*a* of the fastener 26*a* does not extend far enough below the head 24*a* (i.e., the bolt 28*a* is not long enough) to pass the station. The fact that the bolt 28*a* is too short causes the end 48 of the fastener 26*a* to generally tip into the opening 44, causing the fastener 26*a* to fall out of the track 22 (i.e., causing the washer portion 30*a* of the fastener 26*a* to fall out of the recess 32). This causes the fastener 26*a* to fall away from the sorter 20, into a collection device (not shown).

Figure 7:
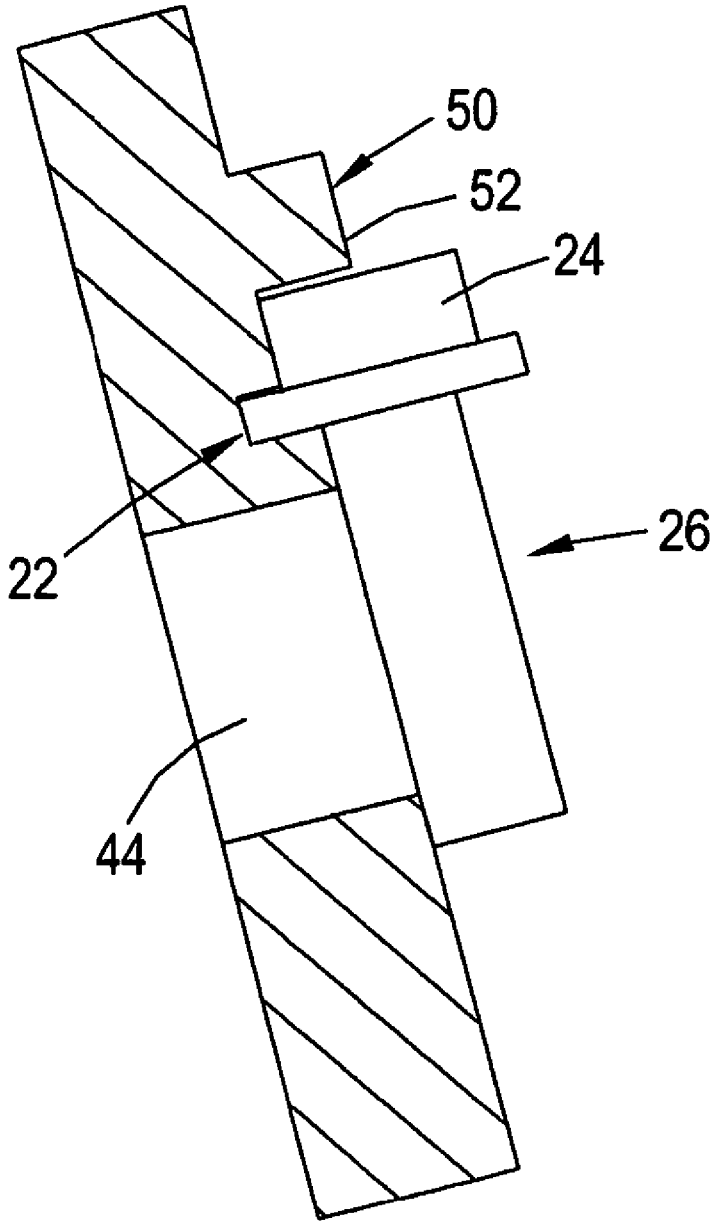
FIG. 7 is a cross-sectional view taken along line 7-7 of FIG. 1, showing a fastener at a second station, wherein a top part of the fastener is short enough to pass the station.

FIG. 7 is a cross-sectional view taken along line 7-7 of FIG. 1, showing fastener 26 at the second station (i.e., station "B" in FIG. 1). The station includes a ramp or cam 50 (see FIG. 2) which is shaped and positioned to provide that only fasteners which do not have too long of a top portion, i.e., too long of a head 24 or too long of a shaft portion extending above the head 24, can pass without the ramp 50 pushing on the fastener 26, causing the fastener 26 to be pushed out of the track 22. If the fastener 26 makes it past this station, the fastener 26 proceeds to the next station (see FIG. 9). The ramp 50 may be provided as an angled surface 52 (see FIG. 2), or an angled surface which meets a flat surface.

Figure 8:
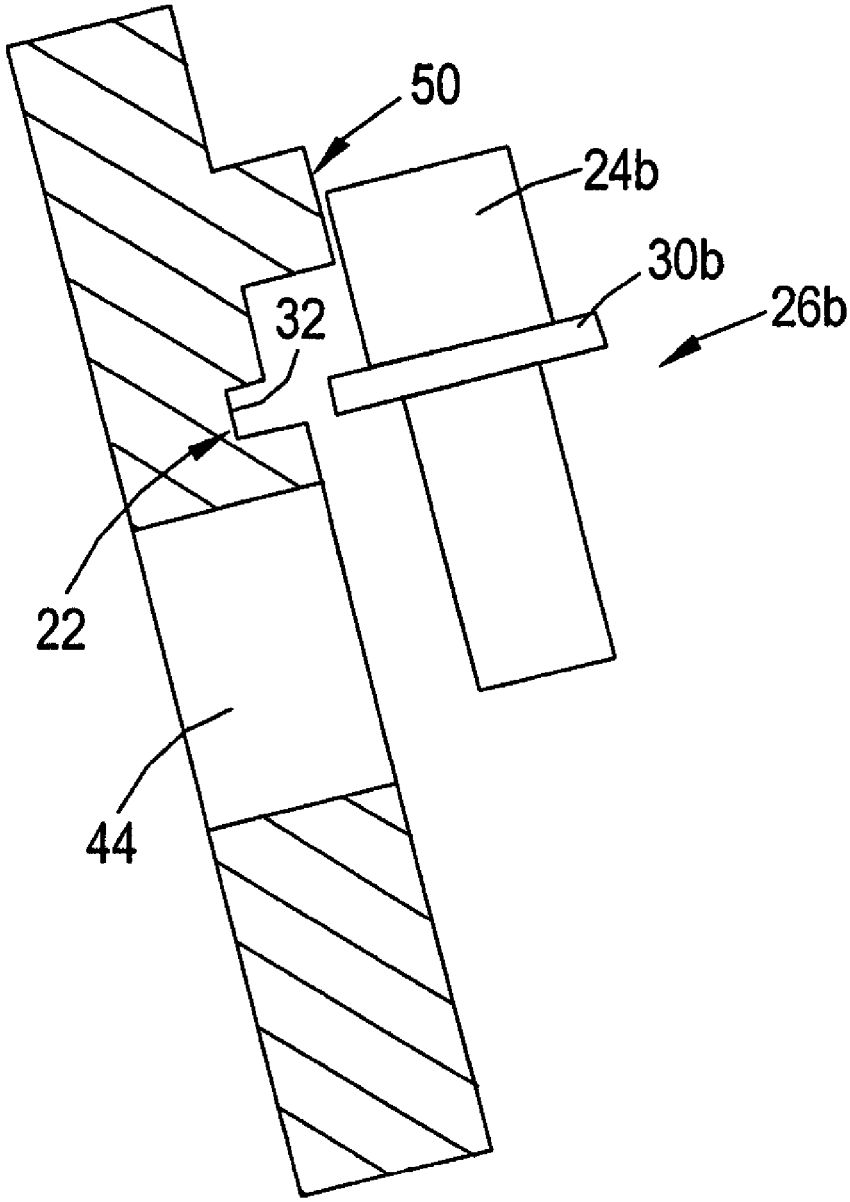
FIG. 8 is similar to FIG. 7, but shows the situation where the head of the fastener is too long to pass the station.

FIG. 8 is similar to FIG. 7, but shows the situation where the head 24*b* of the fastener 26*b* is too long to pass the station. The fact that the head 24*b* is too long causes the head 24*b* to ride up the ramp 50, causing the fastener 26*b* to be pushed out of the track 22 (i.e., causing the washer portion 30*b* of the fastener 26*b* to be pushed out of the recess 32). This causes the fastener 26*b* to fall away from the sorter 20, into a collection device (not shown).

Figure 9:
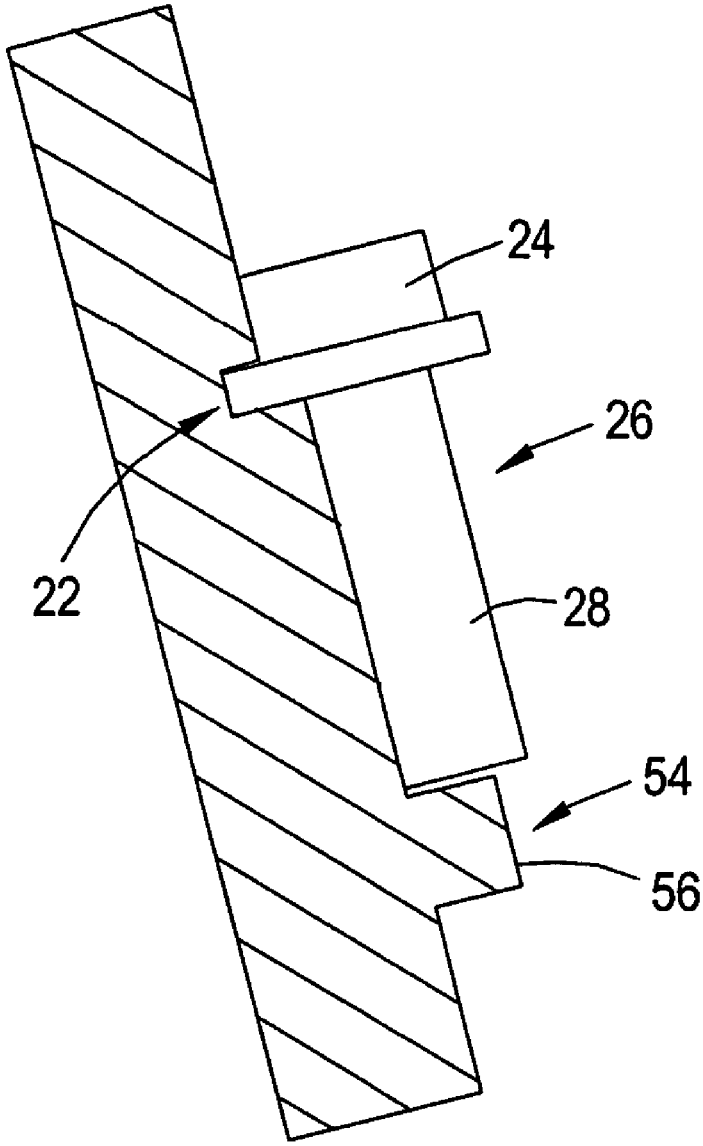
FIG. 9 is a cross-sectional view taken along line 9-9 of FIG. 1, showing a fastener at a third station, wherein a shaft portion which extends below the head is short enough to pass the station.

FIG. 9 is a cross-sectional view taken along line 9-9 of FIG. 1, showing fastener 26 at the third station (i.e., station "C" in FIG. 1). The station includes a ramp or cam 54 (see FIG. 2) which is shaped and positioned to provide that only fasteners which do not have too long of a bolt 28, i.e., too long of a shaft portion extending below the head 24, can pass without the ramp 54 pushing on the fastener 26, causing the fastener 26 to be pushed out of the track 22. If the fastener 26 makes it past this station, the fastener 26 proceeds to the next station (see FIG. 11). The ramp 54 may be provided as an angled surface 56 (see FIG. 2), or an angled surface which meets a flat surface.

Figure 10:
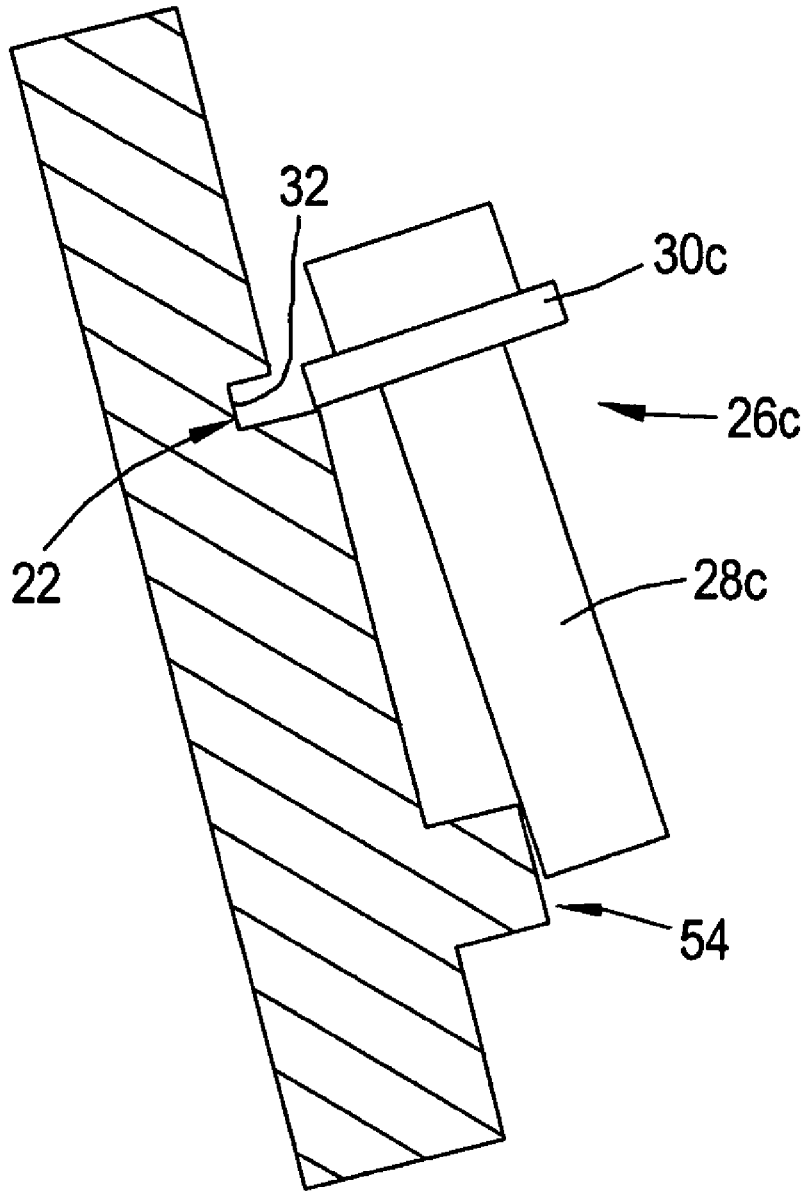
FIG. 10 is similar to FIG. 9, but shows the situation where the shaft portion of the fastener is too long to pass the station.

FIG. 10 is similar to FIG. 9, but shows the situation where the bolt portion 28*c* of the fastener 26*c* is too long to pass the station. The fact that the bolt portion 28*c* is too long causes the bolt 28*c* to ride up the ramp 54, causing the fastener 26*c* to be pushed out of the track 22 (i.e., causing the washer portion 30*c* of the fastener 26*c* to be pushed out of the recess 32). This causes the fastener 26*c* to fall away from the sorter 20, into a collection device (not shown).

Figure 11:
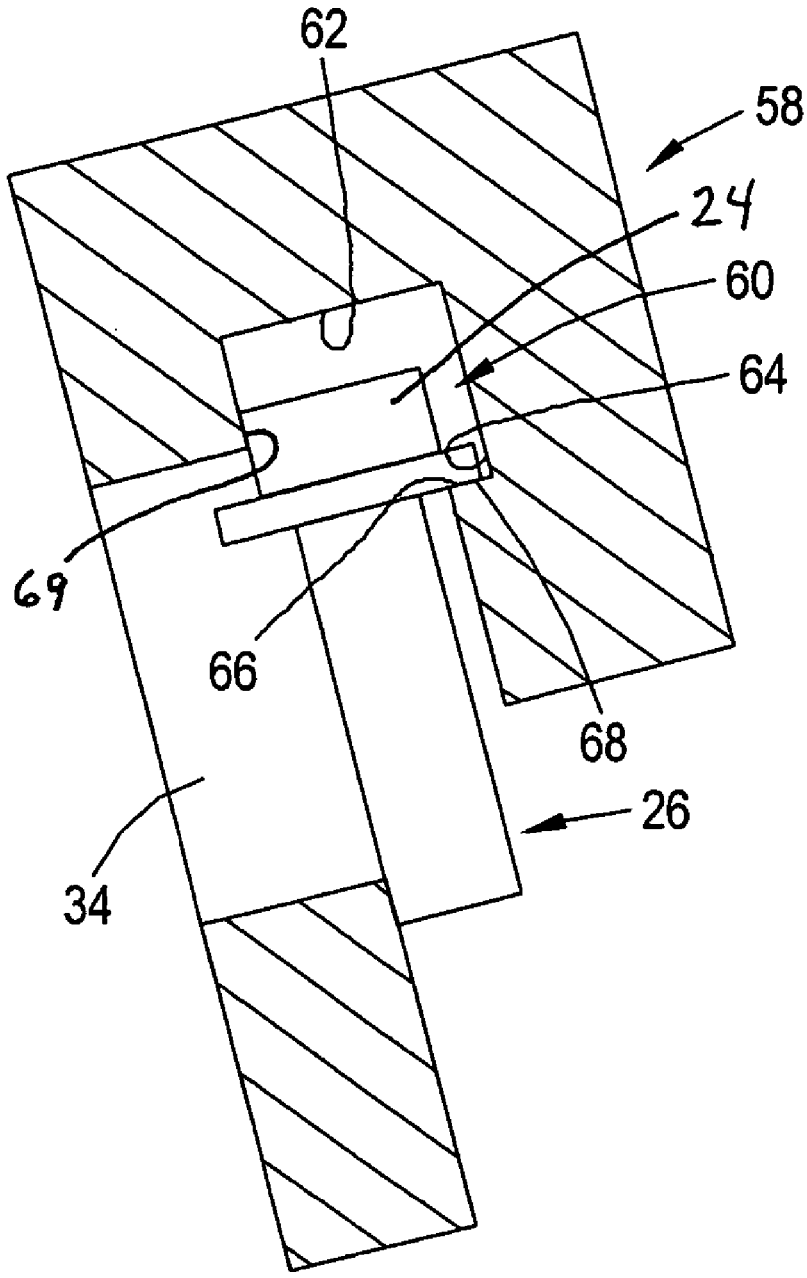
FIG. 11 is a cross-sectional view taken along line 11-11 of FIG. 1, showing a fastener at a fourth station, wherein a washer portion of the fastener is sized such that fastener can pass the station.
Figure 12:
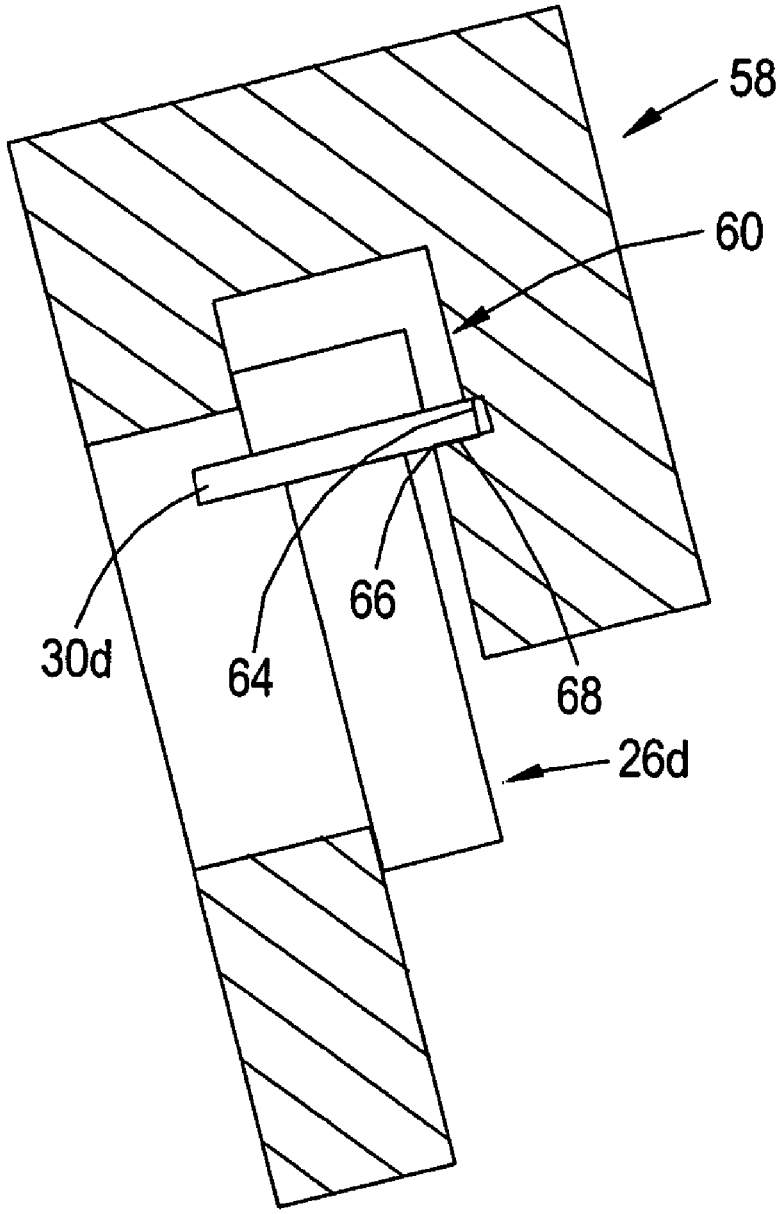
FIG. 12 is similar to FIG. 11, but shows the situation where the washer portion is too large for the fastener to pass the station.

FIG. 11 is a cross-sectional view taken along line 11-11 of FIG. 1, showing fastener 26 at the fourth station (i.e., station "D" in FIG. 1). The station consists of a box-like structure 58 which includes an opening 60 for receiving the head portion 24 and washer portion 30 of a fastener 26. The opening 60 is shaped to provide that only fasteners which have small enough heads and washer portions can enter the structure 58. If the head portion of the fastener is too tall, wall 62 will not allow the fastener 26 to enter the opening 60. As shown in FIG. 12, if the washer portion 30*d* of the fastener 26*d* is too wide, wall 64 (represented by an imaginary, or dashed line in FIG. 12) will not allow the fastener 26*d* to enter the opening 60. In either case, not being able to enter the opening 60 causes the fastener to fall away from the sorter 20, into a collection device (not shown).

If the head portion is not too tall, and the washer portion is not too wide, the head and washer portion of the fastener enter the opening. Once the fastener enters the box-like structure 58 of station "D" (see FIG. 1), corner 66 effectively checks to determine if the washer portion 30 of the fastener 26 is too narrow to allow the fastener to move completely through the station, past the sorter 20. If the washer portion is too narrow, the washer portion will not contact corner 66 or wall 68, and the fastener will fall into opening 34, away from the sorter 20, into a collection device (not shown). Once the fastener 26 enters the box-like structure 58 of station "D" (see FIG. 1), corner 69 as shown in FIG. 11 effectively checks to determine if the head portion 24 of fastener 26 is too short too allow the fastener 26 to move completely through the station, past the sorter 20. If the head portion 24 is too short, the head portion 24 will not contact corner 69, and the fastener 26 will fall into opening 34, away from the sorter 20, into a collection device (not shown).

If a fastener is shaped and sized such that none of the four stations reject the fastener, the fastener may move past the sorter. While four stations have been shown and described, it is anticipated that more or less than four stations may be employed. Also, the stations may be provided in a sequence which differs from that which has been described hereinabove. However, it is anticipated that station "D" (see FIGS. 11 and 12) would be the last station in the sequence. Still further, in some cases, stations may be combined.

The in-line sorter 20 may be formed of plastic. Regardless, preferably it is configured such that it can be positioned, such as bolted, inline with practically any type of fastener feed system. To this end, holes (not shown) may be provided for receiving the bolts for placement. As described above, the sorter 20 is effective at allowing only those fasteners which meet certain, pre-determined specifications to pass all the way through the sorter. Hence, the sorter 20 is effective at preventing foreign fasteners from continuing to be fed through a feed system, thereby preventing jamming and eliminating down time.

While an embodiment of the present invention is shown and described, it is envisioned that those skilled in the art may devise various modifications of the present invention without departing from the spirit and scope of the disclosure.

What is claimed is:

1. A device for sorting fasteners, said device comprising: a plurality of stations for testing whether a fastener meets at least one criteria, wherein the stations are configured to reject fasteners which fail to meet said at least one criteria; a track which is configured to receive washer portions of the fasteners in the track, for having the fasteners move through the stations; and at least one ramp which is configured to push the fastener such that the washer portion comes out of the track and the fastener falls away.

2. A device as recited in claim 1, wherein said track is angled relative to horizontal wherein gravity tends to pull the fasteners along the track.

3. A device as recited in claim 1, wherein said stations are angled relative to vertical.

4. A device as recited in claim 1, said stations comprising a station for rejecting fasteners which have bolt portions which are too short.

5. A device as recited in claim 4, wherein said station for rejecting fasteners which have bolt portions which are too short comprises an opening though which a fastener falls if its bolt portion is too short.

6. A device as recited in claim 1, said stations comprising a station for rejecting fasteners which have too long a head or too long a shaft portion extending above the head.

7. A device as recited in claim 6, said station for rejecting fasteners which have too long a head or too long a shaft portion extending above the head comprising a ramp and an opening, said ramp configured to push said bolt portion such that said washer portion comes out of the track and said fastener falls though said opening.

8. A device as recited in claim 1, said stations comprising a station for rejecting fasteners which have bolt portions which are at least one of too long and too short.

9. A device as recited in claim 8, wherein said station for rejecting fasteners which have bolt portions which are too long comprises a ramp which is configured to push said bolt portion such that said washer portion comes out of the track and said fastener falls away.

10. A device as recited in claim 1, said stations comprising a station for rejecting fasteners which have too large a head, or have washer portions which are either too small or too large.

11. A device as recited in claim 10, wherein said station for rejecting fasteners which have too large a head, or have washer portions which are either too small or too large comprises a structure which includes an opening for allowing entry of only those fasteners which have a small enough head portion and washer portion, wherein said structure is configured to allow fasteners which have too small a washer portion to fall away from said structure.

12. A method of sorting fasteners, comprising using a device which comprises a plurality of stations for testing whether a fastener meets at least one criteria, wherein the stations are configured to reject fasteners which fail to meet said at least criteria; having washer portions of the washers be received in a track and move through the stations; and using a ramp to push the fastener such that the washer portion comes out of the track and the fastener falls away.

13. A method as recited in claim 12, further comprising providing that said track is angled relative to horizontal wherein gravity tends to pull the fasteners along the track.

14. A method as recited in claim 12, further comprising providing that said stations are angled relative to vertical.

15. A method as recited in claim 12, further comprising having the fasteners go though a station for rejecting fasteners which have bolt portions which are too short.

16. A method as recited in claim 12, further comprising having the fasteners go though a station for rejecting fasteners which have too long a head or too long a shaft portion extending above the head.

17. A method as recited in claim 12, further comprising having the fasteners go though a station for rejecting fasteners which have bolt portions which are too long.

18. A method as recited in claim 12, further comprising having the fasteners go though a station for rejecting fasteners which have too large a head, or have washer portions which are either too small or too large.

* * * * *